US006497587B2

(12) United States Patent
Di Mario

(10) Patent No.: US 6,497,587 B2
(45) **Date of Patent: *Dec. 24, 2002**

(54) CONNECTOR COUPLED BY PRESSURE FOR TELECOMMUNICATIONS SYSTEMS

(75) Inventor: Umberto Di Mario, Rome (IT)

(73) Assignee: Microproject Di Campani L. & C. S.N.C., Chieti (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/319,106

(22) PCT Filed: Nov. 29, 1996

(86) PCT No.: PCT/IT96/00236

§ 371 (c)(1),
(2), (4) Date: Jun. 1, 1999

(87) PCT Pub. No.: WO98/24155

PCT Pub. Date: Jun. 4, 1998

(65) Prior Publication Data

US 2002/0127911 A1 Sep. 12, 2002

(51) Int. Cl.[7] ..... H01R 9/05
(52) U.S. Cl. ..... 439/578
(58) Field of Search ..... 439/578–582, 439/583, 584, 99, 585, 394, 98; 174/75 C, 78

(56) References Cited

U.S. PATENT DOCUMENTS

| | | | | | |
|---|---|---|---|---|---|
| 3,264,602 | A | * | 8/1966 | Schwartz | 439/578 |
| 3,448,430 | A | * | 6/1969 | Kelly | 439/610 |
| 3,610,812 | A | * | 10/1971 | Furusawa | 174/70 S |
| 3,757,278 | A | * | 9/1973 | Schumacher | 439/585 |
| 3,828,303 | A | | 8/1974 | Sladek et al. | 439/585 |
| 3,858,156 | A | | 12/1974 | Zarro | 439/221 |
| 3,963,321 | A | * | 6/1976 | Burger et al. | 439/584 |
| 4,047,788 | A | * | 9/1977 | Forney, Jr. et al. | 439/585 |
| 4,126,372 | A | * | 11/1978 | Hashimoto et al. | 439/583 |
| 4,131,332 | A | * | 12/1978 | Hogendobler et al. | 439/585 |
| 4,249,790 | A | * | 2/1981 | Ito et al. | 439/583 |
| 4,920,233 | A | * | 4/1990 | Kincaid | 174/36 |
| 5,061,206 | A | | 10/1991 | Kawanami et al. | 439/582 |
| 5,066,248 | A | * | 11/1991 | Gaver, Jr. et al. | 439/578 |
| 5,321,207 | A | | 6/1994 | Huyang | 174/75 C |
| 5,351,388 | A | * | 10/1994 | Van Den Berg et al. | 29/602.1 |
| 5,393,244 | A | * | 2/1995 | Szegda | 439/394 |
| 5,397,252 | A | * | 3/1995 | Wang | 439/620 |
| 5,632,621 | A | * | 5/1997 | Szegda | 439/578 |
| 5,800,211 | A | * | 9/1998 | Stabile et al. | 439/578 |
| 5,820,408 | A | * | 10/1998 | Wang | 439/578 |

FOREIGN PATENT DOCUMENTS

| | | |
|---|---|---|
| EP | 0020188 A | 12/1980 |
| EP | 0693805 A | 1/1996 |

* cited by examiner

*Primary Examiner*—Tulsidas Patel
*Assistant Examiner*—Son V. Nguyen
(74) *Attorney, Agent, or Firm*—Smith, Gambrell & Russell, LLP

(57) ABSTRACT

A coaxial connector, particularly for the mechanical and electrical connection of an outer screening conductor of a coaxial cable with the outer screening of a female coaxial connector, said coaxial connector comprising a slidable sleeve having a first and a second coaxial inner cylindrical seat, said first seat having an inner diameter corresponding to or slightly greater than the outer diameter of said cable and said second seat having an inner diameter slightly greater than the outer diameter of the outer wall of said connector, in such a way to obtain a pressure coupling of the coaxial cable screen between the sleeve of the coaxial connector and the outer wall of the female coaxial connector.

49 Claims, 4 Drawing Sheets

CONNECTOR COUPLED BY PRESSURE FOR TELECOMMUNICATIONS SYSTEMS

BACKGROUND OF THE INVENTION

The present invention concerns a connector coupled by pressure for telecommunications systems. More specifically, the invention concerns a connector to be employed to couple, in a quick and electrically perfect way, a coaxial cable with a female coaxial connector, that may be provided with an outer thread and a central contact, for example, in an elastic central contact for F type connectors.

It is known to connect coaxial cables with electrical or electronic circuits. More particularly, it is known for coaxial connections to be employed to realize systems for the distribution of radio and TV signals. Metallic clamps are generally employed. Such clamps are inexpensive but have different technical drawbacks.

These drawbacks are even more evident when considering advancements in the state of the art making it common to use signal reception and distribution systems having frequencies higher than 2000 MHz, such as in satellite reception systems, cable networks, MMDS systems and so on.

In order to obviate these drawbacks, it is advisable to use male and female coaxial connectors. The first is coupled to the coaxial cable and the other to the final circuit. The techniques already known generally provide for the connection of coaxial cables with coaxial connectors, the welding or screwing of the two poles to the cable of the connector ends, or the screwing or crimping of the male coaxial connector onto the screen conductor of the coaxial cable. Further, the coupling of a cable to a connector is done by screwing or coupling, or by the introduction of two metallic parts, a rigid one and an elastic one, respectively.

On the basis of these solutions, past and present systems, patented or not, and commercial coaxial connectors have been developed. The choice of these kinds of solutions for the coupling of coaxial cables is due to the limited use of coaxial joints employed on professional apparatuses only, and are highly expensive relative to the cost of one or two traditional coaxial joints.

The most recent technological development has broadened the application of coaxial cables, and consequently, the application of relevant connectors which, if employed for applications such as radio frequencies distribution in the domestic buildings, also influence the cost of the work necessary to obtain a technically efficient but cheap and easy to apply coupling.

Within this field of application, it includes the solution suggested according to the present invention, which is the ability to satisfy the above needs, by means that are completely different from systems already employed.

OBJECTS OF THE INVENTION

The main object of the present invention is to obtain a connector that allows a coupling between a coaxial cable and a female coaxial connector so as to allow, within a range of frequencies between 0 and up to or beyond 2000 MHz, a constant impedance power transfer, with a maximum concentration, a maximum electromagnetic screening, a minimum loss of signal, a minimum mismatching and a minimum parasitic capacitance.

A further object of the invention is to obtain a connector that allows a connection between a coaxial cable and a female coaxial connector that has a good mechanical coupling but is also easily removable.

A further object of the invention is to obtain a connector that allows a connection between a coaxial cable and a female coaxial connector that is easily made, and can be made without the need of any specific tool, with a minimum number of sizes and that is also very inexpensive.

INVENTION SUMMARY

These and other objectives are obtained according to the present invention utilizing a connector coupled by pressure for telecommunication systems that employs as the central pin of the connection, the rigid central conductor of the coaxial cable. The connection is fixed by pressure on the outer surface of the female connector by a sleeve slidable on the cable. The sleeve has, on its rear portion, a diameter corresponding to or slightly greater than the diameter of the coaxial cable. The sleeve has on its front portion a diameter slightly greater than the one of the outer surface of the female connector.

It is therefore a specific object of the invention to produce a coaxial connector, particularly for the mechanical and electrical connection of the outer screening conductor of a coaxial cable with the outer screening of a female coaxial connector. The coaxial connector comprises a slidable sleeve having a first and a second coaxial inner cylindrical seat. The first seat has an inner diameter corresponding to, or slightly greater than the outer diameter of the cable. The second seat has an inner diameter slightly greater than the outer diameter of the outer wall of the connector. The sleeve allows for a pressure coupling of the coaxial cable screen between the sleeve coaxial connector and the outer wall of the female coaxial connector.

Preferably, according to the invention, at least one projection can be provided within the second seat. Also according to the invention, the portion of the connector corresponding to the first seat can be long in order to obtain a greater coupling stability alternatively, this portion can be short to reduce the dimensions. Furthermore, according to the invention, outside the second seat, close to the outer connection zone with the first seat, a circular projection can be provided. Also, according to the invention, the connection zone between the first and second seats can be realized by a sloped wall. Also, according to the invention, spaced longitudinal ribs can be provided outside said second seat. Also, according to the invention, on the inner surface of the first and second seat a roughness can be provided.

Within the first seat, longitudinal lugs can be further provided, preferably three lugs circumferentially spaced at 120°. Also, within said second seat, longitudinal lugs can be provided, preferably three lugs circumferentially spaced at 120°.

Always according to the invention, the connector is used for the connection of the coaxial cable screen made up of metallic braid, with the threaded outer screening of a female coaxial connector. Or it is used for the connection of the coaxial cable screen made up of one or more metallic foils, with the threaded outer screening of a female coaxial cable, or for the connection of a coaxial cable screen, made up of metallic, braid and one or more metallic foils, with the outer screening of a female coaxial connector.

Furthermore, according to the invention, the coaxial connector can be made up of plastic material, elastic material, such as rubber, or elastic metallic material.

The present invention will be now described, for illustrative but not limitative purposes, according to its preferred embodiments, with particular reference to the figures of the enclosed drawings, wherein:

DETAILED DESCRIPTION

Figure 1:
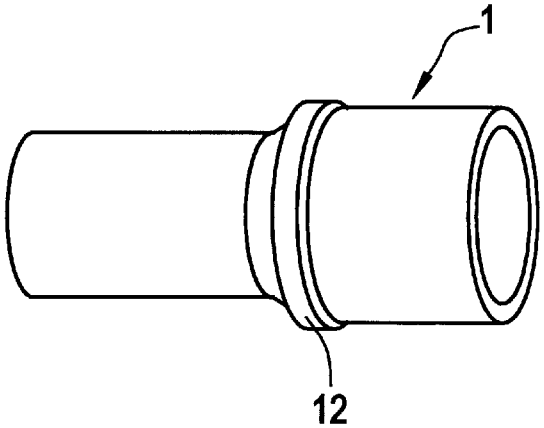
FIG. 1 is a perspective view of a first embodiment of a slidable sleeve connector according to the invention.

Making reference to the figures of the drawings enclosed, the slidable sleeve coaxial connector 1 according to the present invention is comprised of an integral body of material, preferably semirigid or elastic, in the hollow inner part of which two coaxial cylindrical seats 2, 3 are obtained, said seats being connected by a sloped wall 4, and having the inner smaller diameter d1 corresponding to or greater than the outer diameter of the coaxial cable 20 used for the connection and the bigger inner diameter d2 slightly bigger than the outer diameter of the threaded surface 41 of the coaxial connector 40 in order to allow fixation of the screen 21 of the coaxial cable 20 between the threaded outer surface 41 of the coaxial connector 40 and the inner surface 5 having the diameter d2 of the slidable sleeve connector 1.

Figure 2:
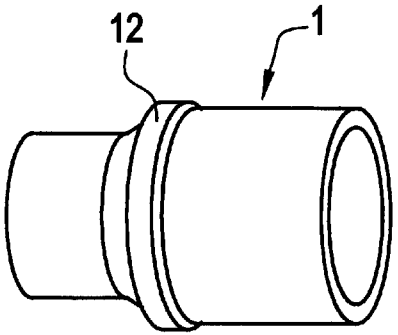
FIG. 2 is a perspective view of a second embodiment of a slidable sleeve connector according to the invention.

The cylindrical portion 2 of the connector 1 wounding the coaxial cable 20 is quite long, as shown in FIG. 1, in order to obtain a greater mechanical stability for the connection, or shorter, as shown in FIG. 2, to realize a connection in limited spaces, such as the embedded boxes for the fittings of the distribution systems of the radio/TV signals.

The inner surfaces of the coaxial connector 1, according to the invention, can be rough in order to increase the adherence of the connector 1 with the outer sheath 22 of the coaxial cable 20 and with the threaded outer surface 41 of the female coaxial connector 40. The circular opening 6 of the connector 1 having diameter d1 ends with a flared part 7 making it easier the introduction of the connector 1 on the terminal of the coaxial cable 20.

The circular opening 8 of the connector 1 having the diameter d2 ends with a flared portion 9 making easier the introduction of the connector 1 on the female coaxial connector 40.

For particular uses, the slidable sleeve connector 1 can be provided in the inner part with projections 10, making it much more difficult to extract the female coaxial connector 40.

The thickness of the slidable sleeve coaxial connector is a function of the dimensions of the coaxial cable 20 to be connected and of the material employed for the realization of the connector 1. The outer wall 11 of the slidable sleeve coaxial connector 1 has a cylindrical bump 12 to make it easier, by creating a grip upon which it is possible to exert a higher pressure with the hands, the insertion and extraction operations of the slidable sleeve coaxial connector 1 from the female coaxial connector 40.

A first seat longitudinal lug 25 and second seat longitudinal lug 26 can be provided within the connector. Additional lugs could be provided and preferably spaced at 120° to avoid sliding of the connector 1. Longitudinal ribs 27 can also be provided on the outside of the second seat.

Figure 3:
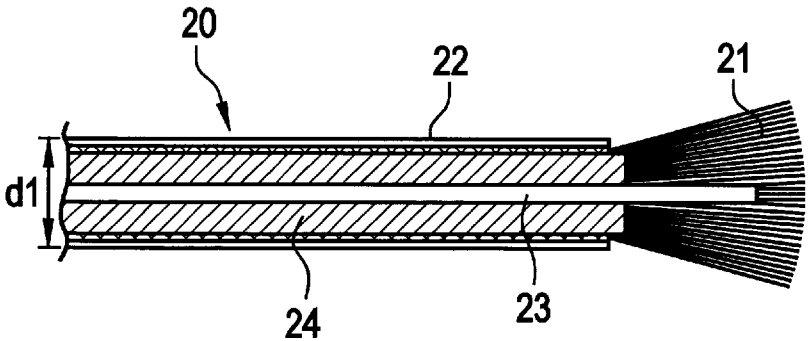
FIG. 3 is a sectional lateral view of the head of the coaxial cable ready for the connection.
Figure 4:
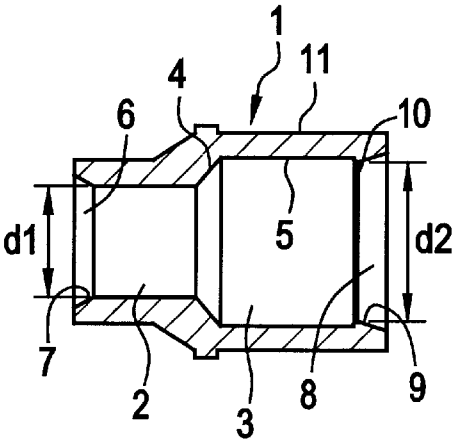
FIG. 4 is a sectional view of a connector according to the invention.
Figure 5:
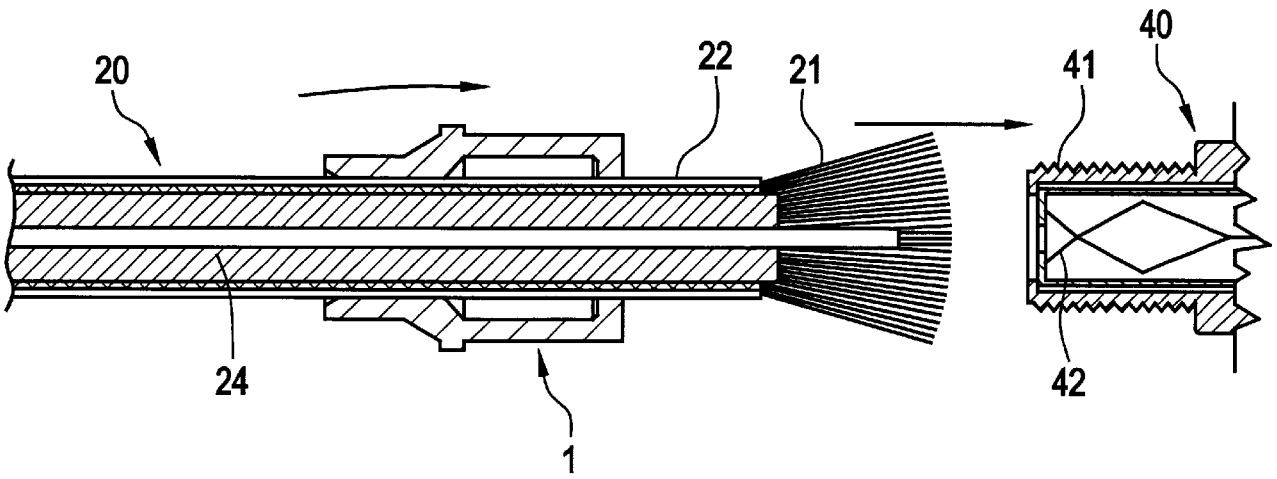
FIG. 5 is a sectional view of the coaxial cable, of the sleeve connector and of the female coaxial connector of the F kind ready for the realization of the coaxial connection.
Figure 6:
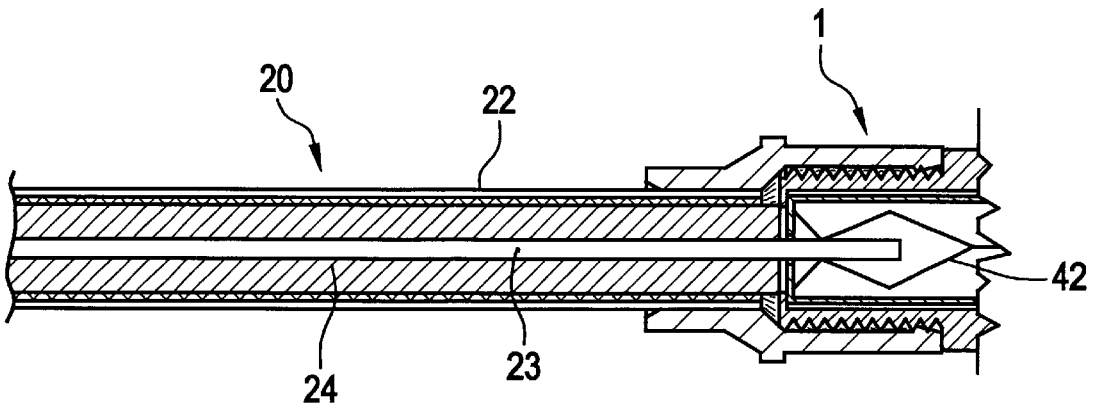
FIG. 6 is a sectional view of a connection of a coaxial cable with a female coaxial connector of the F kind realized employing the slidable sleeve connector according to the invention.
Figure 7:
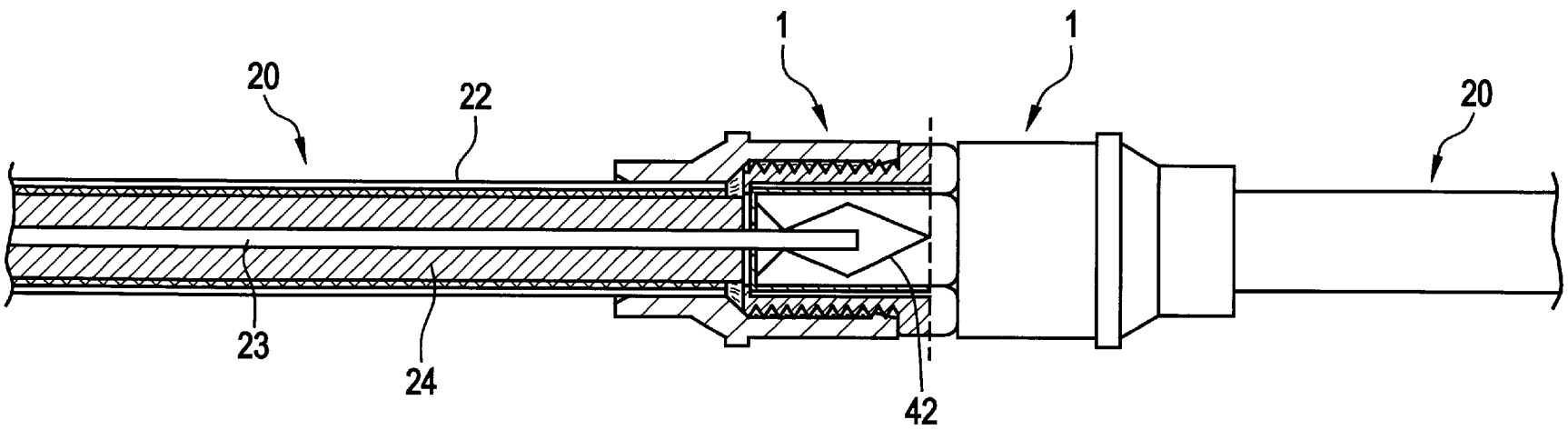
FIG. 7 is a partially sectioned view of a connection between two cables realized employing two slidable sleeve connectors according to the invention and a double female coaxial connector of the F kind.
Figure 8:
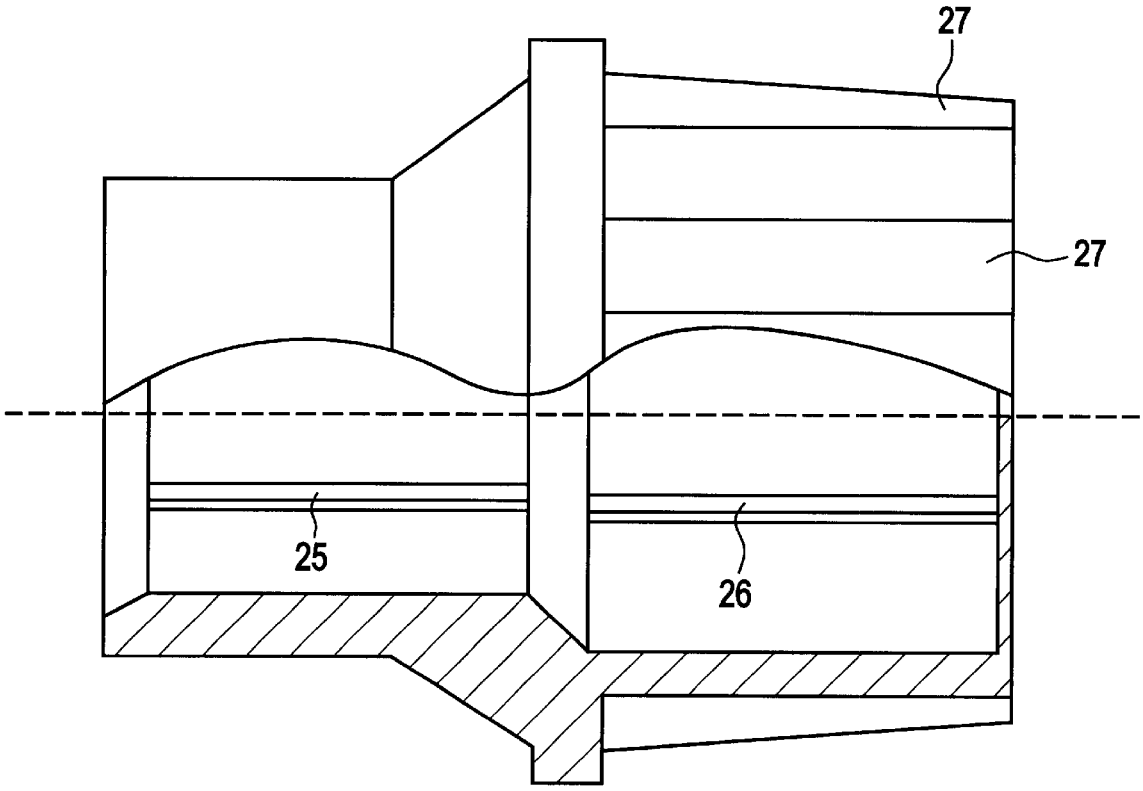
FIG. 8 is a partially sectioned view of a connector according to the invention.

The use of the slidable sleeve coaxial connector 1 as described is particularly simple. As a first step, the connector 1 is introduced from the part with the smaller diameter d1 on the terminal of the coaxial cable 20 to be connected. Then, the coaxial cable 20 is suitably prepared as shown in FIG. 3, widening the screen 21 of the same cable and obtaining the situation shown in FIG. 5. Now the central conductor 23 of the coaxial cable 1 within the central tap 42 of the female coaxial connector 40 Finally, the sleeve slidable connector 1 slides along the coaxial cable 20 toward the female connector 40 up to the complete coupling with the threaded outer surface 41 of the connector 40 with the connector 1, as shown in FIG. 6: by this step, the screen 21 of the coaxial cable 20 is automatically lied on and tightened on the thread 41 of the female coaxial connector 40 at the same time obtaining the double mechanical and electrical coupling between the cable 20 and the connector 40.

From the description of the coaxial coupling obtained by the solution according to the present invention, the advantages that the coaxial slidable sleeve connector 1 allows with respect to the known coaxial connection systems are quite evident.

It is evident that the ease and the convenience of use of the solution, according to the invention, which can be set up without employing any tool but the one necessary to strip the coaxial cable 20. Further, the electrical features of the coaxial coupling are optimal: the concentricity and the complete screening of the connection are ensured by the immediate electric contact between the cable screen 21 and the screening outer surface 41 of the connector 40, contact obtained immediately after that the screen 21 of the coaxial cable 20 is widened and detached from the dielectric 24 dividing the same screen 21 from the central conductor 23 of the coaxial cable 20. These features allow a perfect working of the coaxial connection within a frequencies range between 0 and up to and beyond 2000 MHz.

The connector 1 according to the invention further allows making a coaxial connection within small spaces, such as the space available within the usual connection blocks of the radio/TV signal distribution systems provided within houses.

A further remarkable advantage is the low total cost of the coaxial connection that such a connector allows. Low total costs obtained in considering both the cost for the material of the connector with the cost of the labor necessary for the realization of the connection. As is evident from the above specification of the solution according to the invention and of its use, both costs are very low; lower than the costs necessary to make a valid coaxial connection employing different connectors.

The cable 20 can freely rotate about the axis of the central connector also after the coupling. Further, the connector 1 according to the invention completely covers the connector, protecting the same. Another advantage is due to the fact that the connector 1 according to the invention can be used more than once in case it is necessary to make the connection again. Moreover, squeezing of the cable does not occur as squeezing occurs with the solutions of the prior art.

All the above mentioned advantages are such to make the present invention advantageously usable in any application involving the coupling of coaxial cables. The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A coaxial connection for the mechanical and electrical connection of an outer screening conductor of a coaxial cable with an outer wall conductor of a female coaxial connector comprising:

a non-conductive unitary sleeve having a first coaxial inner cylindrical seat and a second coaxial inner cylindrical seat;

said first coaxial inner cylindrical seat having a first wall with a first inner diameter dimensioned for receipt of the coaxial cable;

said second coaxial inner cylindrical seat having a second wall with a second inner diameter dimensioned for receipt of the outer wall conductor of the female coaxial connector;

wherein the diameter of the first coaxial inner cylindrical seat is different from the diameter of the second coaxial inner cylindrical seat;

at least one projection provided on the second coaxial inner cylindrical seat;

wherein the outer screening conductor of the coaxial cable is pressure coupled to the outer wall conductor of the female coaxial connector by-the non-conductive unitary sleeve.

2. The coaxial connection according to claim 1, wherein a circular projection is provided upon an exterior of the second coaxial inner cylindrical seat.

3. The coaxial connection according to claim 1, wherein a connection zone between the wall of the first coaxial inner cylindrical seat and the wall of the second coaxial inner cylindrical seat is a sloped wall.

4. The coaxial connection according to claim 1, wherein spaced longitudinal ribs are provided outside the second coaxial inner cylindrical seat.

5. The coaxial connection according to claim 1, wherein the first coaxial inner cylindrical seat has an inner surface that is rough.

6. The coaxial connection according to claim 1, wherein the second coaxial inner cylindrical seat has an inner surface that is rough.

7. The coaxial connection according to claim 1, wherein the first coaxial inner cylindrical seat has at least one longitudinal lug.

8. The coaxial connection according to claim 1, wherein the wall of the first coaxial inner cylindrical seat has three longitudinal lugs circumferentially spaced at 120°.

9. The coaxial connection according to claim 1, wherein the wall of the second coaxial inner cylindrical seat has at least one longitudinal lug.

10. The coaxial connection according to claim 1, wherein the wall of the second coaxial inner cylindrical seat has three longitudinal lugs circumferentially spaced at 120°.

11. The coaxial connection according to claim 1, wherein the non-conductive unitary sleeve connects the coaxial cable outer screening conductor comprising a metallic braid with a threaded outer wall conductor of the female coaxial connector.

12. The coaxial connection according to claim 1, wherein the non-conductive unitary sleeve connects the coaxial cable outer screening conductor comprising at least one metallic foil with a threaded outer wall conductor of the female coaxial connector.

13. The coaxial connection according to claim 1, wherein the non-conductive unitary sleeve connects the coaxial cable outer screening conductor comprising a metallic braid and at least one metallic foil with a threaded outer wall conductor of the female coaxial connector.

14. The coaxial connection according to claim 1, wherein the non-conductive unitary sleeve comprises a plastic material.

15. The coaxial connection according to claim 1, wherein the non-conductive unitary sleeve comprises an elastic material.

16. The coaxial connection according to claim 1, wherein the non-conductive unitary sleeve comprises rubber.

17. A method for joining a coaxial cable directly onto a female coaxial connector using a non-conductive unitary sleeve having a first coaxial inner cylindrical seat and a second coaxial inner cylindrical seat, the first coaxial inner cylindrical seat having a wall with an inner diameter dimensioned for receipt of the coaxial cable and the second coaxial inner cylindrical seat having a wall with an inner diameter dimensioned for receipt of an outer wall conductor of the female coaxial connector, comprising:

applying the non-conductive unitary sleeve to obtain a pressure coupling of an outer screening conductor of the coaxial cable with the outer wall conductor of the female coaxial connector;

securing the non-conductive unitary sleeve to the outer wall conductor of the female coaxial cable with a projection on the second coaxial inner cylindrical seat.

18. A coaxial connector which provides a mechanical and electrical connection of an outer screening conductor of a coaxial cable with an outer wall conductor of a female coaxial connector, comprising:

a unitary sleeve formed of a non-conducting material, said unitary sleeve having a first sleeve section having an interior surface defining a first coaxial inner cylindrical seat with an inner diameter dimensioned for sliding receipt of a coaxial cable, a second sleeve section having an interior surface defining a second coaxial inner cylindrical seat with an inner diameter which is different than the inner diameter of said first sleeve section and dimensioned for receipt of the outer wall conductor of the female coaxial connector, and an intermediate sleeve section surface extending between the interior surfaces of said first and second sleeve sections, and wherein the second sleeve section is formed of the non-conducting material and dimensioned in such a way as to achieve an axial slide on coupling of the coaxial cable and female coaxial connector with a pressure coupling of the screening conductor of the coaxial cable between said second sleeve section and the outer wall conductor of the female coaxial connector.

19. The connector of claim 18 wherein said non-conducting material is a non-metallic material.

20. The connector of claim 19 wherein said non-conducting material is a plastic material.

21. The connector of claim 20 wherein said unitary sleeve further comprises an annular locking projection extending radially inward off of the interior surface of said second sleeve section.

22. The connector of claim 18 wherein said unitary sleeve further comprises an annular locking projection extending radially inward off the interior surface of said second section.

23. The connector of claim 22 wherein said projection is dimensioned for releasable locking engagement relative to a threaded surface of the outer wall conductor of the female coaxial connector.

24. The connector of claim 22 wherein said annular projection is positioned closer to a free end of said second sleeve section than an opposite end bordering said intermediate sleeve section surface.

25. The connector of claim 24 wherein the free end of said second sleeve section includes an interior flare surface.

26. The connector of claim 25 wherein a free end of said first sleeve section includes an interior flare surface.

27. The connector of claim 18 wherein said intermediate sleeve section surface is an interior sloped surface extending between the interior surfaces of said first and second sections.

28. The connector of claim 27 wherein said intermediate sleeve section surface diverges in extending from a smaller diameter interior surface of said first sleeve section to a larger diameter interior surface of said second sleeve section.

29. The connector of claim 28 wherein said unitary sleeve includes a finger grip surface on an exterior surface of said sleeve to facilitate non-tool coupling of the coaxial cable to the female coaxial connector.

30. The connector of claim 18 wherein said unitary sleeve includes a finger grip surface on an exterior surface of said sleeve to facilitate non-tool coupling of the coaxial cable to the female coaxial connector.

31. The connector of claim 30 wherein said finger grip surface includes a circumferential ridge.

32. The connector of claim 31 wherein said circumferential ridge is positioned axially at a location commensurate with the intermediate sleeve section surface.

33. The connector of claim 18 wherein said first and second sleeve sections have an axial length designed to position a central conductor of the coaxial cable within the second coaxial inner cylindrical seat which also receives a central conductor reception port of the female coaxial connector when in a final slide on coupling state.

34. The connector of claim 18 wherein the interior surface of said second. sleeve section is cylindrical and circumferentially uninterrupted and said sleeve is dimensioned so as to produce a consistent inward radial coupling pressure so as to maintain a constant impedance power transfer between the coaxial cable and female coaxial connector.

35. The connector of claim 18 wherein said pressure coupling is a coupling which allows for free rotation of the coaxial cable about a central axis of coaxial cable while maintaining an axial locked in position state between the coaxial cable and female coaxial connector.

36. An assembly comprising the coaxial connector of claim 18 and a coaxial cable and female coaxial connector coupled together by said coaxial connector.

37. The assembly of claim 36 wherein said female connector has a threaded female outer wall conductor which includes a reception port for a central conductor of the coaxial cable and wherein said first and second sleeve sections are dimensioned to place both the reception port and an exposed section of the central conductor to be received by said reception port within the second coaxial inner cylindrical seat.

38. The assembly of claim 37 wherein said second sleeve includes a projection extending radially inward for enhanced locking engagement with the threaded female outer wall.

39. The assembly of claim 36 wherein said first and second sleeve sections are formed of a plastic material.

40. The assembly of claim 38 wherein the screening conductor includes a metallic braid which extends axial out away from a sheathing end of the coaxial cable for reception between the outer wall conductor of the female coaxial connector and the second sleeve section.

41. The assembly of claim 38 wherein the screening conductor includes a metallic foil which extends axial out away from a sheathing end of the coaxial cable for reception between the outer wall conductor of the female coaxial connector and the second sleeve section.

42. A method for joining a coaxial cable directly onto a female coaxial connector using a unitary sleeve having a first coaxial inner cylindrical seat and a second coaxial inner cylindrical seat, the first coaxial inner cylindrical seat having a wall with an inner diameter dimensioned for receipt of the coaxial cable and the second coaxial inner cylindrical seat having a wall with an inner diameter dimensioned for receipt of an outer wall conductor of the female coaxial connector; wherein the diameter of the first coaxial inner cylindrical seat is different from the diameter of the second coaxial inner cylindrical seat comprising:

axial hand sliding of the unitary sleeve along the coaxial cable to effectuate a tool free, axial slide on coupling of the coaxial cable and the female coaxial connector with a concentric pressure coupling of the screening conductor of the coaxial cable between the wall of the second coaxial inner cylindrical seat and the outer wall conductor of the female coaxial connector.

43. The method of claim 42 wherein axial sliding of the unitary sleeve includes sliding said unitary sleeve so as to position the screening conductor so as to extend axial out away from a sheathing end of the coaxial cable for reception between the outer wall conductor of the female coaxial connector and the wall of the second coaxial inner cylindrical seat.

44. The method of claim 42 wherein axial sliding of the unitary sleeve includes axial sliding a unitary sleeve having a circumferential projection extending radially inward from the wall of the second coaxial inner cylindrical seat and into contact with the screening conductor.

45. The method of claim 44 wherein axial sliding the unitary sleeve includes positioning said circumferential projection so as to engage with threads on the outer wall conductor of the female connector.

46. The method of claim 42 wherein the joining of the coaxial cable and female connector includes axial coupling while allowing rotation of the coaxial cable relative to the female connector while in an operating position.

47. The method of claim 42 wherein sliding the unitary sleeve includes sliding a semi-rigid plastic sleeve which deflects and returns to achieve a pressure coupling wherein a concentrically constant pressure coupling is achieved which facilitates a constant power transfer status between the female connector and contacting screening conductor.

48. The method of claim 41 wherein upon completion of the pressure coupling a central conductor of the coaxial cable extends into an electrical connection with the female coaxial connector within a space defined by the second coaxial inner cylindrical seat.

49. The method of claim 17 wherein upon completion of the pressure coupling a central conductor of the coaxial cable extends into an electrical connection with the female coaxial connector within a space defined by the second coaxial inner cylindrical seat.

* * * * *